United States Patent [19]

Marshala

[11] Patent Number: 4,629,402

[45] Date of Patent: Dec. 16, 1986

[54] VALVE ASSEMBLY

[75] Inventor: Dennis L. Marshala, Midwest City, Okla.

[73] Assignee: Lift Technology, Inc., Oklahoma City, Okla.

[21] Appl. No.: 672,809

[22] Filed: Nov. 19, 1984

[51] Int. Cl.[4] ..... F04B 19/04; F04B 21/06

[52] U.S. Cl. ..... 417/456; 417/514; 417/520

[58] Field of Search ..... 417/456, 514, 520

[56] References Cited

U.S. PATENT DOCUMENTS

| | | | |
|---|---|---|---|
| 3,023,710 | 3/1962 | Tyree, Jr. | 417/520 |
| 3,612,101 | 10/1971 | Paulovich | 137/624.18 |
| 4,504,199 | 3/1985 | Spears | 417/514 |
| 4,531,896 | 7/1985 | Spears | 417/456 |
| 4,534,715 | 8/1985 | Jones | 417/456 |

*Primary Examiner*—Carlton R. Croyle
*Assistant Examiner*—Theodore W. Olds
*Attorney, Agent, or Firm*—Bill D. McCarthy

[57] ABSTRACT

An improved submersible pump valve assembly, actuated by the reciprocating movement of a sucker rod extended from surface equipment to a downhole traveling valve located in a tubing string, the valve assembly comprising a rotatable fluid port assembly supported in a barrel assembly which has a beveled seating surface with fluid ports therethrough. A reciprocatable actuator member having a screw rod portion coacts with a gear bore of the fluid port assembly to open the fluid ports thereof during the downstroke movement of the actuator member and to close the fluid ports during the upstroke movement. Also, the actuator member opens and closes the fluid ports of the barrel assembly alternately during its downstroke and upstroke positions, respectively. A middle rod connector, which connects the actuator to the sucker rod, has multiple fluid jetting ports which serve to agitate particulates in the reservoir liquids being pumped.

4 Claims, 14 Drawing Figures

VALVE ASSEMBLY

BACKGROUND OF THE INVENTION

1. Field of the Invention

The present invention relates generally to the field of pumps that are used to pump fluids from oil wells and the like, and more particularly but not by way of limitation to an improved valve assembly for use with such downhole pumps.

2. Prior Art

There have been a number of prior art patents that teach the basics of problems encountered in downhole pumping processes. An early teaching of a downhole pumping device is U.S. Pat. No. 456,128 issued to Darling in 1891. The Darling patent teaches the combination of check valves with a lower trap valve assembly. A later example, Lindgren's U.S. Pat. No. 2,363,343, issued Nov. 21, 1944, discusses the gas locking phenomenon encountered with gaseous fluids when using conventional traveling valves that have ball check valves. While numerous improvements in traveling valves have been made over the years since Lindgren's early teaching, the problems addressed by him remain largely unsolved.

Particularly, valve assemblies associated with downhole pumps continue to present serious difficulties, including gas lock and fluid pounding, as well as problems encountered with downhole particulates and corrosion. A recent valve assembly sold by Spears Oil Tool, Inc. of Tomball, Tex., features a rotary spindle that alternately opens and closes fluid flow ports by the operation of a traveling guide which is reciprocated by the valve rod connected to surface equipment, the guide coacting with a screw rod that extends from the spindle member. The rotational positions of the barrel member blocks or opens the ports in the housing.

It appears that the Spears device, like other similar valves, does reduce gas leaking under ideal conditions, but such ideal conditions are rarely encountered in a subsurface reservior. Difficulties remain, including those associated with back flowing particulates, such as sand and the like, and with corrosion. Also, the free travel of moving parts in most traveling valves, including the guide member of the Spears device, is frequently hindered when operated in a tilted position as where the oil well bore is not disposed vertically from the ground's surface, a condition often found in a downhole environment.

SUMMARY OF THE INVENTION

The present invention provides an improved traveling valve assembly that forms a part of a subsurface pump of the type that is actuated by a reciprocatable sucker rod extending from surface located power equipment down the tubing in an oil well to attach to the traveling valve assembly disposed with a piston plunger in an appropriately placed cylinder immersed in the reservior. As the sucker rod is reciprocated, quantity of reservior liquid is lifted into the tubing above the subsurface pump. This continuing pumping action causes reservior liquid to be lifted to the surface.

The improved valve assembly of the present invention comprises a barrel assembly having an internal bore extensive therethrough. A reciprocatable actuator member is supported in the barrel assembly, and interacts with a fluid port assembly disposed in the barrel assembly. The fluid port assembly comprises a stationary first ported member and a rotational second ported member, the first and second ported members having fluid ports that are alignable for fluid passsage and disalignable to prevent fluid passage, the fluid ports caused to be aligned (open) by operation of the actuator on its downstroke and disaligned (closed) on the upstroke of the actuator.

The actuator member has a downwardly extending screw rod receivable in a gear bore disposed in the second ported member, the up and down movement of the screw rod relative to the second ported member effecting selective rotation thereof to open and close the fluid ports. Simultaneously with closing the fluid ports, an upper seating surface is brought into sealing engagement with a seating surface on the barrel assembly during upstroke of the sucker rod.

The valve assembly further comprises a middle rod connector that interconnects the actuator and the lower end of the sucker rod, the middle rod connector having a plurality of fluid ports that cause the upwardly pumped fluid to be jetted to agitate, or turbulate, fluid carried particulate matter so that it is prevented from settling back into the valve assembly.

It is an object of the present invention to provide an improved valve assembly which operates to open and close the fluid ports thereof with greater integrity in a subsurface reservoir unaffected by vertical tilt conditions.

Another object of the present invention is to provide an improved valve assembly which avoids downhole gas locking while maintaining sufficient flow velocity to agitate downhole particulates.

Yet another object is to provide an improved valve assembly which is less expensive to manufacture, which has longer service life and which is readily repairable by relatively low skilled personnel.

Other objects, advantages and features of the present invention will become clear from the following detailed description when read in view of the included drawings and the appended claims.

BRIEF DESCRIPTION OF THE DRAWINGS

FIG. 8 is a view of the valve assembly similar to that shown in FIG. 1 except that FIG. 8 shows the valve assembly in the upstroke condition while FIG. 1 shows the valve assembly in the downstroke condition.

DESCRIPTION

Figure 1:
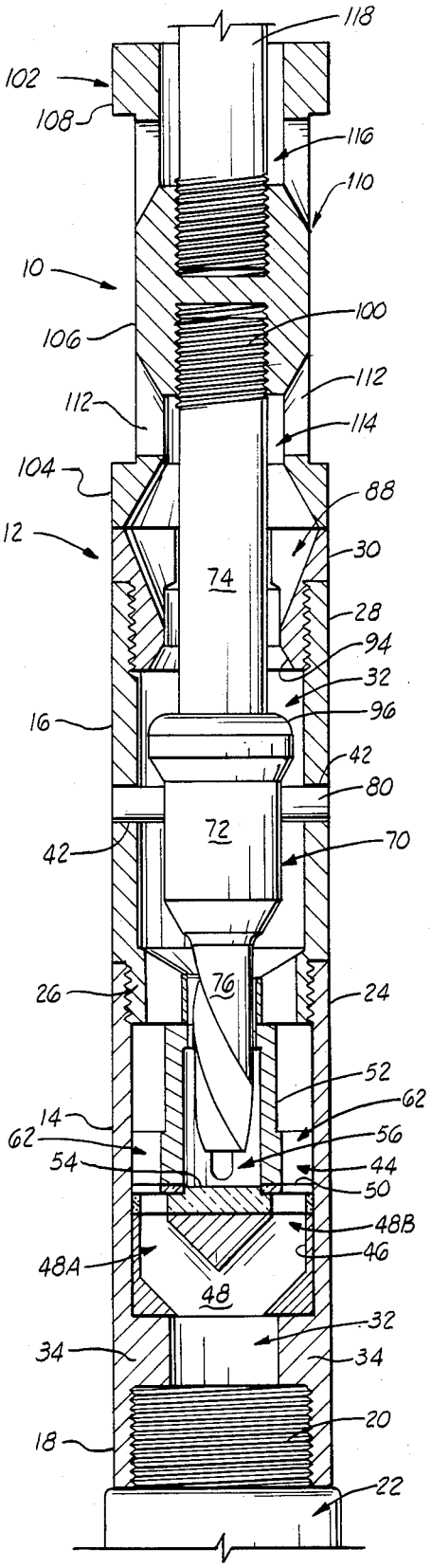
FIG. 1 is a side elevational, cross-sectional view of a valve assembly constructed in accordance with the present invention.

Referring to the drawings in general, and to FIG. 1 in particular, shown therein is a partial cutaway elevational view of a valve assembly 10 constructed in accordance with the present invention. As will be discussed more fully hereinbelow, the valve assembly 10 is used in conjunction with other conventional downhole subsurface pump components to form a pump which effects upward pumping of liquid in an oil well bore or the like while preventing the gas locking that often happens as gas is released from the fluid, as well as the prevention of other deleterious conditions.

The valve assembly 10 comprises a barrel assembly or housing 12 that has a cylindrically shaped lower barrel 14 and a cylindrically shaped upper barrel 16. The lower barrel 14 has a first end 18 that is internally threaded to receive the upper threaded end 20 of the hollow cored plunger of a traveling plunger piston 22. The lower barrel 14 also has a second end 24 that is inwardly threaded. While not shown, it will be understood by persons of ordinary skill that the valve assembly 10 and the plunger piston 22 are disposed for reciprocation within an appropriately sized pump cylinder that is disposed in the oil well tubing, also not shown. Further, other components of a conventional subsurface pump are also not shown since the makeup of such pumps is fully understood to be available and variably made up by the numerous pump suppliers in this country and abroad. That is, such components as additional check valves, sand traps, etc. are conventional and made up on demand in accordance with reservior conditions.

The upper barrel 16 has a lower first end 26 that is externally threaded and is engageable with the upper second end 24 of the lower barrel 14 as shown, and the upper barrel 16 has an internally threaded upper second end 28. The barrel housing 12 has an externally threaded collar member 30 that is threadingly connected to the second end of the upper barrel 16. As made up, the interconnection of the lower barrel 14, the top barrel 16 and the collar member 30 form the barrel housing 12, and an internal bore 32 extends the length of the barrel housing 12 for selective fluid passage therethrough.

Figure 2:
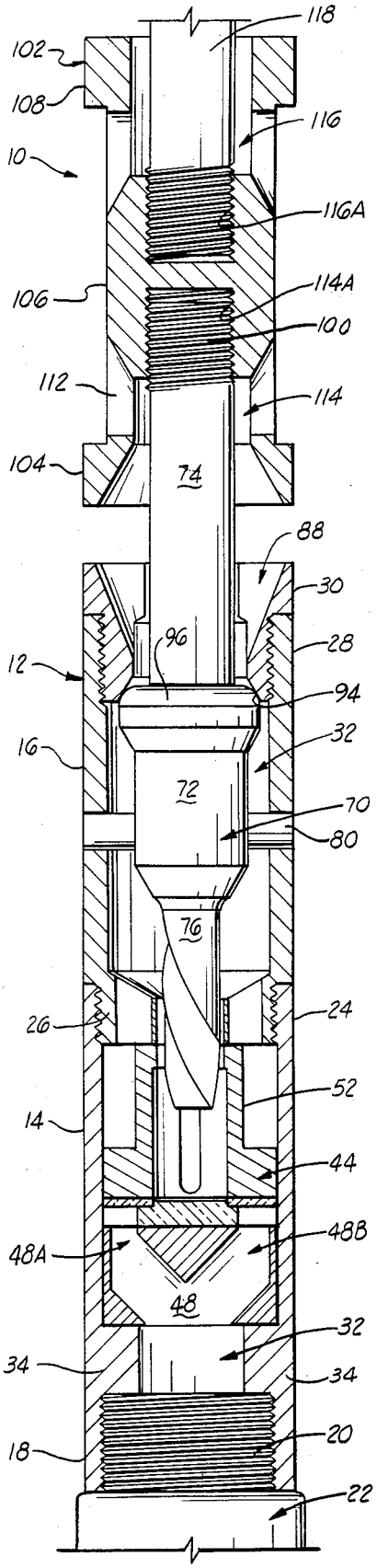
FIG. 2 is a side elevational, cross-sectional view of the lower barrel member of the valve assembly of FIG. 1.
Figure 2:
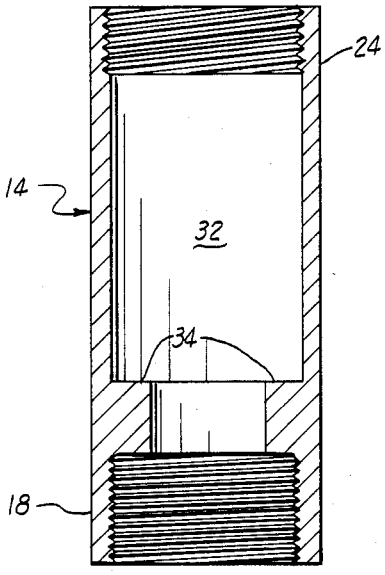
Figure 3:
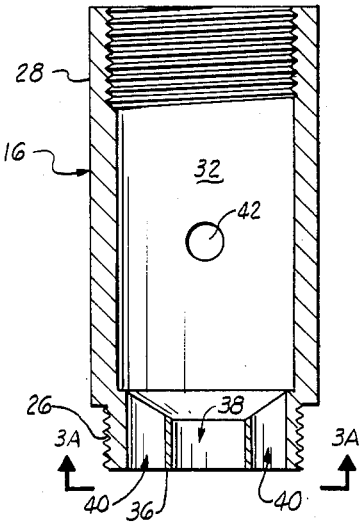
FIG. 3 is a side elevational, cross-sectional view of the upper barrel member of the valve assembly of FIG. 1.

For clarity, the lower barrel 14 is shown by itself in FIG. 2, as is the upper barrel 16 in FIG. 3. A shoulder support 34 is formed about the inner wall of the lower barrel 14 for the purpose of supporting the below described porting members. The lower first end 26 of the barrel 16 is partially sealed via a plug member 36 which has a central guide bore 38 and a plurality of peripheral bores 40. A pair of aligned bores 42 (only one is shown in FIG. 3) is provided in the wall of the upper barrel 16 for a purpose described hereinbelow.

Disposed in the lower barrel 16 is a fluid port assembly 44 which is supported on the shoulder support 34 as shown in FIG. 1. The fluid port assembly 44 is comprised of a first ported member 46 that is dimensioned to be received within the lower barrel 16 and secured therein on the shoulder support 34 in a stationary position via adhesive bonding of conventional type, or alternatively by the use of a conventional set screw. The first ported member 46 is generally a cylindrically shaped member having a central bore 48 that is bifurcated to form a pair of fluid ports 48A and 48B that communicate with the internal bore 32 of the barrel housing 12 unless closed in the manner hereinafter described. Preferably, the upper portion of the first ported member 46 is a ceramic disk that is adhesively bonded to the lower portion thereof in order to present an upper sealing surface 50 on the first ported member 46. Such ceramic disk material is available from R I Ceramic Company of Norman, Okla., a subsidiary of Coors Porcelain Corporation of Golden, Colo.

Figure 4A:
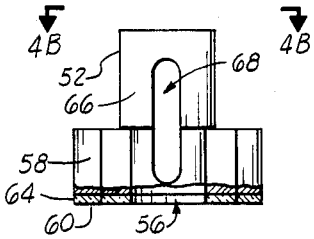
FIG. 4A is a side elevational, partial cutaway, view of the second ported member of the valve assembly of FIG. 1.
Figure 3A:
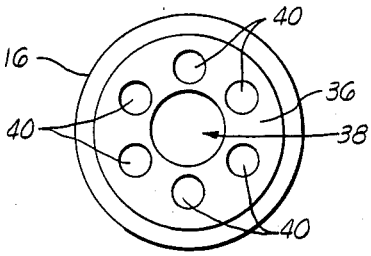
FIG. 3A is a view seen from 3A—3A in FIG. 3.
Figure 4B:
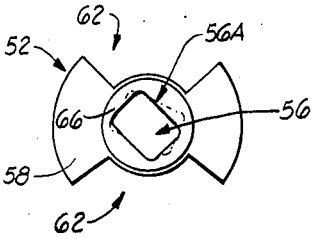
FIG. 4B is a view as seen from 4B—4B in FIG. 4A.

The fluid port assembly 44 also comprises a second ported member 52 that is supported by first ported member 46. Preferably, the first ported member 46 has an upwardly extensive land portion 54 that is slidingly received in a bore 56 which extends upwardly in through the second ported member; this serves to register and true the two ported members 46, 52. This second ported member 52 is also depicted in FIGS. 4A and 4B.

The second ported member 52 has a lower seating portion 58 that has a lower sealing surface 60 that is slidingly supported on the upper sealing surface 50 of the first ported member 46. The lower seating portion 58 is generally cylindrically shaped except that relief is provided on opposing sides thereof to provide clearance ports 62. Preferably, the lower portion 64 of the lower seating portion 58 is a ceramic disk of the type mentioned hereinabove with regard to the first ported member 46. The alumina ceramic available can present a MOH hardness of 9 which approaches just under that of diamond material for hardness.

The second ported member has an upper portion 66 which is extensive upwardly from the lower seating portion 58. The bore 56 extends through the upper portion 66, and near the top thereof has the configuration of a gear bore 56A, the shape of which will be made more clear with the discussion that follows. Along each side of the upper portion 66 is a clearance slot 68 that extends along the outer surface thereof and which has communication with the bore 56 (and thus the gear bore 56A). These slots 68 (only one of which is visible in FIG. 4A) are disposed above and in the clearance ports 62 so that the gear bore 56A is maintained free of particulate material (such as sand) by the fluid induction created in the clearance slots 68 as reservior liquids flow upward through the aligned fluid ports 48A, 48B, and 62 of the first ported member 46 and the second ported member 52, respectively. As shown in FIG. 1, the height dimensions of the first ported member 46 and the second ported member 52 are selected such that the top of the second ported member 52 is disposed just below the plug member 36 at the lower first end 26 of the upper barrel 16, and the gear bore 56A is coaxially aligned with the central guide bore 38.

Disposed within the barrel housing 12 is an elongated actuator member 70 that has a central body portion 72, an upwardly extending shank rod 74, and a downwardly extending screw rod 76. As shown in FIG. 1, the actuator member 70 is disposed for reciprocating upward and downward movement, with the shank rod 74 connected to the sucker rod as discussed hereinbelow, with the body portion 72 confined to the interior of the upper barrel member 16 and with the screw rod portion 76 extensive through the central guide bore 38 and into the interior of the lower barrel member 14.

Figure 5:
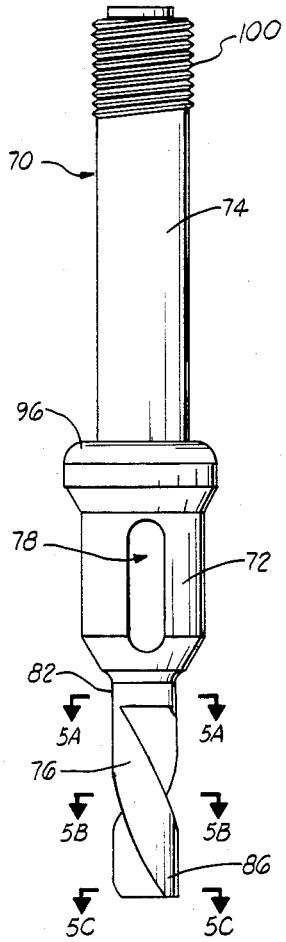
FIG. 5 is a side elevational view of the actuator member of the valve assembly in FIG. 1.

The actuator member 70 is also shown in FIG. 5. As shown, a longitudinally guide slot 78 extends through the body portion 72, and a guide pin 80 is provided to clearingly extend through the guide slot 78 when assembled in the barrel housing 12, with the ends of the guide pin 80 being supported by press fit in a pair of aligned bores 42 in the wall of the upper barrel 16. This permits reciprocating upward and downward movement of the actuator member 70 while restricting any rotational movement thereof.

Figure 5A:
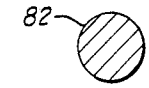
FIGS. 5A, 5B and 5C are views taken respectively at 5A—5A, 5B—5B and 5C—5C in FIG. 5.
Figure 5B:
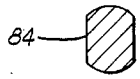

The screw rod 76 of the actuator 70 has several geometrical configurations along its length, the significance of which will now be made clear. An upper portion 82 has a circular cross section (as depicted in FIG. 5A); a medial portion 84 is flatted on opposing sides (as shown in FIG. 5B); and a voluted portion spirals between the medial portion 84 and a distal portion 86 (the latter portion depicted in FIG. 5C).

As depicted in FIG. 4B, the gear bore 56A is generally rectangularly shaped and is sized to fit over the flatted cross sections of the screw rod 76 of the actuator member 70, the screw rod 76 selectively extensive through the gear bore 56 into the bore 56. The corners of the gear bore 56A may be rounded in relief as shown by the phantom lines in FIG. 4B to avoid binding with the screw rod 76 as the screw rod 76 is received in the gear bore 56A. The operation of the actuator 70 with regard to the second ported member 52 will be made more clear hereinbelow.

Figure 6:
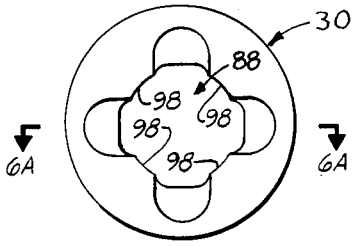
FIG. 6 is a plan view of the collar member of the valve assembly of FIG. 1.
Figure 6A:
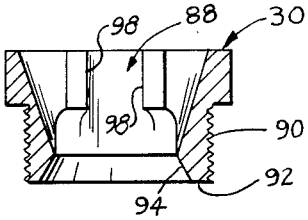
FIG. 6A is a view taken at 6A—6A in FIG. 6.

Turning to FIGS. 1, 6 and 6A, it will be noted that the collar member 30 has a bore 88 through which the shank rod 74 of the actuator member 70 extends, and the collar member 30 is mounted on the upper end of the upper barrel 16 via external threads 90 thereon. The lower end 92 of the collar member 30 has a beveled seat 94. The upper part of the body portion 72 has a seating surface 96 (FIG. 5) that seals against the beveled seat 94 when the actuator member 70 is lifted to its upstroke position as depicted in FIG. 8. As shown in FIG. 6A the bore 88 is beveled so as to provide a greater flow capacity therethrough about the shank rod 74. That is, the bore 88 is beveled except for projecting land areas 98 which provide an inner bore definition that permits ready passage of the shank rod 74 therethrough without permitting undesired torquing against the actuator 70.

Figure 7:
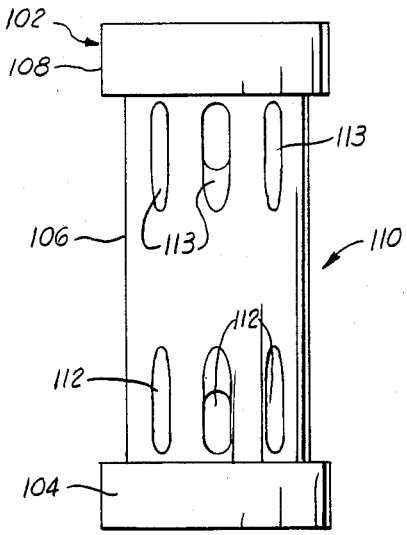
FIG. 7 is a side elevational view of the middle rod connector of the valve assembly of FIG. 1.

The upper end 100 of the shank rod 74 is externally threaded and is threadingly attached to a middle rod connector 102 (shown in FIGS. 1 and 7). The middle rod connector 102 is generally a cylindrically shaped member having a lower end portion 104, a medial portion 106 and an upper end portion 108. The outer diameters of the upper and lower end portions are dimensioned to have the same diameter as that of the barrel members 114 and 116. The diameter of the medial portion 106 is smaller than the diameter dimension of the ends 104, 108 so as to provide an annular flow passageway 110 between the medial portion 106 and the pump cylinder or tubing (neither shown, but selected as the installation may require, and in which the valve assembly 10 will be disposed for operation). A plurality of fluid ports 112 extend through the lower end 104 to communicate with the annular flow passageway 110, and a plurality of fluid ports 113 extend through the upper end 108 to communicate with the annular flow passage 110.

A pair of bores 114 and 116 extend partially through the middle rod connector 102 from the opposite ends thereof. A threaded portion 114A receives the threaded upper end 100 of the shank rod 74 as shown. Also, a threaded portion 116A receives the lower threaded end of a sucker rod 118 that extends to ground level and is operably connected to reciprocating power equipment (not shown) such as the conventional horse head driver.

Thus fluid flow relative to the middle rod connector 102 will be through the fluid ports 112 into the annular flow passageway 110, and then through the fluid ports 113 into and out of the bore 116.

When assembled, the above described components of the rotational valve assembly 10 interconnect as follows. Referring once again to FIG. 1, the actuator member 70 is disposed in the upper barrel 16 and the guide pin 80 installed. Next the collar member 30 is attached to the upper end of the upper barrel 16. Once the first ported member 46 is placed into the lower barrel member 14 and appropriately secured therein on the shoulder support 34, the second ported member 52 is placed onto the first ported member 46. Next the upper barrel 16 is brought into engagement with the lower barrel 14, taking care to insert the screw rod 76 of the actuator member 70 into the gear bore 56A while the fluid ports 48A, 48B are covered by the lower seating portion 58 so that these ports will open as the actuator member 70 is lowered into place, once the upper barrel 16 is mounted to the lower barrel 14. This proper orientation can be checked by appearing upwardly into the internal bore 32 to ascertain that the fluid ports of the first and second ported members 46, 52 are aligned (as opposed to being disaligned in the downstroke position). Finally, the middle rod connector 102 is threadingly engaged to the upper end 100 of the shank rod 74 of the actuator 70. The valve assembly 10 can then be connected to the hollow plunger piston 22 and to the lower end of the sucker rod 118 as shown.

FIG. 1 depicts the actuator member 70 in its down position as the sucker rod 118 has been lowered by the surface equipment. In this position, the actuator member 70 has traveled within the internal bore 32 of the barrel housing 12, and during the travel of the valve assembly downward in the reservior liquids, the length of the screw rod 76 has been pushed through the gear bore 56A, causing the second ported member 52 to rotate a quarter turn on the first ported member 46 so as to open the fluid ports 48A, 48B. That is, the second ported member 52, on the downstroke of the actuator member 70, is turned (via the interaction of the gear bore 56A with the screw rod 70) so that the clearance ports 62 are rotated to align with the fluid ports 48A, 48B of the first ported member 46; the bore 88 is unblocked by the beveled seat 96 of the actuator body portion 72 as the actuator member 70 is lowered.

Figure 5C:
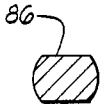

As viewable in FIG. 5, the spiral twist of the screw rod 76 is 90 degrees. That is, as depicted in FIGS. 5B and 5C, the travel along the flatted surface of the screw rod 76 is only a quarter turn. As the screw rod 76 is caused to travel through the gear bore 56A into the bore 56, the second ported member 52 will be caused to rotate a quarter of a complete turn; thus only minimal friction will be encountered in the movement of the second ported member 52. This is especially so when the upper sealing surface 50 and lower sealing surface 60 are comprised of the aforementioned ceramic material which is especially smooth and wear resistant.

FIG. 8 is similar to the view of FIG. 1 except the actuator member 70 is shown in its upstroke position. That is, surface equipment connected to the rotational valve 10 via the sucker rod 82 is on the upstroke and has caused the second ported member 52 to rotate to its closed position relative to the first ported member 46. Moving from the downstroke (opened) position shown in FIG. 1, as the sucker 82 is raised, the actuator member 70 is caused to travel upwardly, and since the actuator member 70 is restrained from rotation via the guide pin 80 that extends through its longitudinal guide slot 78, the gear bore 56A of the second ported member 52 interacts with the spiraled screw rod 76 of the actuator member 70 to rotate the second ported member 52 a quarter turn. This causes the second ported member 52 to assume a position in which its lower seated portion 58 is placed in blocking relationship to the fluid ports 48, 48B of the first ported member 46; that is, the clearance ports 62 of the second ported member 52 are caused to be disaligned with the fluid ports 48A, 48B of the first ported member 46. This blocks flow communication through the internal bore 32 throughout the length of the lower and upper barrels 14, 16 and further through the bore 88 of the collar member 30, thereby trapping the reservior liquids that above the fluid port assembly 44 and actuator member 76 during upstroke lifting action of the sucker rod 118.

The features and advantages of the valve assembly 10 of the present invention are varied and many. Because of the fact that the valve assembly 10 opens and closes mechanically, it does not rely on gravity or downhole pressures for operation, and unlike a conventional ball and seat valve, gas locking is prevented since the valve surfaces always retain contact and are opened or closed rapidly by simple rotational action.

The sure mechanical movement of the rotational valve assembly 10 permits close tolerance machining, which substantially prevents the intrusion of downhole particulates, such as sand, from jamming the valve ports. Conventional check valves have no means to force such particulates away from the seating surfaces during closure operation, while the particulates that do tend to accumulate are swept upward by the jetting action of the port design and placement of the present invention.

The improved design of the middle rod connector 102, which is moved via the sucker rod 118 causes reservoir liquids to jet upwardly above the valve assembly 10 to keep particulates agitated and moving uphole out of the pump chamber, thus enabling other moving parts to work more efficiently with increased life. This is enhanced by the actuator member 70 which is caused to close against the beveled seat 94 of the collar member 30 on the upstroke simultaneously when the valve assembly 10 is in its closed position, thereby keeping particulates from reentering the internal bore 30.

When assembled to the plunger of a conventional donwhole stroker pump, the valve assembly 10 installs like any conventional traveling valve. Thus, it is clear that the present invention is well adapted to carry out the objects and to attain the ends and advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. In a subsurface pump actuated by a reciprocatable sucker rod for producing well liquids from a subsurface reservoir involving a piston adapted to reciprocate within a cylinder immersed in said reservoir, said piston being provided with a traveling valve, the improvement which comprises valve means connected to said sucker rod for lifting a body of fluid during upstrokes of said sucker rod, said valve means comprising:

a barrel assembly having an internal bore and comprising:

a lower barrel member; and an upper barrel assembly connected to the lower barrel and having a beveled seating surface with at least one fluid port therethrough;

an actuator member reciprocatingly supported in the lower barrel and having an upper seating surface sealingly engageable with the beveled seating surface of the upper barrel in the upstroke position of the actuator member, the actuator member reciprocated by the sucker rod between upstroke and downstroke positions;

connector means for connecting the actuator member to the sucker rod, the connector means comprising a middle rod connector having a plurality of fluid ports which effect upward jetting of the lifted reservoir liquids so that particulate matter is caused to be agitated above the valve means; and fluid port means supported by the lower barrel of the barrel assembly for alternately opening and closing the internal bore to fluid flow, the fluid port means comprising:

a first ported member adhesively bonded to, and supported by, the lower barrel member for stationary attachment thereto, the first ported member having at one fluid port therethrough; and a second ported member rotatingly supported on the first ported member and having a number of fluid ports therethrough equal to and alignable with the fluid ports of the first ported member in an open position thereof and disalignable with the fluid ports of the first ported member in a closed position thereof, the actuator member operably connected to the second ported member so that the second ported member is rotated to the open position on the downstroke of the actuator member and rotated to the closed position on the upstroke thereof to effectuate lifting of the reservoir liquids on the upstroke, the actuator member having a body portion, shank rod portion extensive upward from the body portion and a downwardly extending screw rod, the shank rod portion connected to the middle rod connector for reciprocation by the middle rod connector, the second ported member having a gear bore engageable by the screw rod such that upstroke and downstroke reciprocation of the screw rod effects rotation of the second ported member between the open and closed positions thereof, the body portion having a longitudinally extending guide slot therethrough, and the valve means further comprising a guide pin extensive through the guide slot and supported by the barrel assembly so that the actuator member is restricted to reciprocation movement.

2. In a subsurface pump actuated by a reciprocatable sucker rod for producing well liquids from a subsurface reservoir involving a piston adapted to reciprocate within a cylinder immersed in said reservoir, said piston being provided with a traveling valve, the improvement which comprises valve means connected to said sucker rod for lifting a body of fluid during upstrokes of said sucker rod, said valve means comprising:

a barrel assembly having an internal bore and comprising:

a lower barrel member; and an upper barrel assembly connected to the lower barrel member and comprising:

an upper barrel member; and a collar member supported on the upper barrel member and having a beveled seating surface with at least one fluid port therethrough;

an actuator member reciprocatingly supported in the lower barrel and having an upper seating surface sealingly engageable with the beveled seating surface of the upper barrel in the upstroke position of the actuator member, the actuator member reciprocated by the sucker rod between upstroke and downstroke positions, the actuator member comprising a downwardly extending screw rod, and wherein the second ported member has a gear bore engageable by the screw rod such that upstroke and downstroke reciprocation of the screw rod effects rotation of the second ported member between the open and closed positions thereof;

connector means for connecting the actuator member to the sucker rod, the connector means comprising a cylindrically shaped middle rod connector member having a plurality of fluid ports which effect upward jetting of the lifted reservoir liquids so that particulate matter is caused to be agitated above the valve means, the middle rod connector member comprising:

a lower end having a first outer diameter dimension;

a medial portion having a second outer diameter dimension; and an upper end having an outer diameter dimension substantially equal to the first outer diameter dimension, the medial portion forming an annular flow passageway with the inner wall of the downhole tubing when installed therein, the upper and lower ends having fluid ports disposed to effect jetting fluid flow through the fluid ports and the annular flow passageway; and fluid port means supported by the lower barrel of the barrel assembly for alternately opening and closing the internal bore to fluid flow, the fluid port means comprising:

a first ported member supported by the lower barrel member and having at least one fluid port therethrough; and a second ported member rotatingly supported on the first ported member and having a number of fluid ports therethrough equal to and alignable with the fluid ports of the first ported member in an open position thereof and disalignable with the fluids ports of the first ported member in a closed position thereof, the actuator member operably connected to the second ported member so that the second ported member is rotated to the open position on the downstroke of the actuator member and rotated to the closed position on the upstroke thereof to effectuate lifting of the reservoir liquids on the upstroke; and wherein the actuator member has an upper surface which sealingly engages the seating surface of the collar member on the upstroke of the sucker rod simultaneously with the movement of the second ported member to the closed position by the downwardly extending screw rod portion of the actuator member.

3. The improvement of claim 2 wherein the first ported member is characterized as having an upper sealing surface and wherein the second ported member is characterized as having a lower sealing surface, at least one of said upper sealing surface and lower sealing surface being an alumina ceramic material.

4. The improvement of claim 2 wherein the second ported member has a lower seating portion on which a lower sealing surface is disposed, the second ported member having an upper portion extensive upwardly from the lower seating portion and having the gear bore disposed therein, the upper portion further having at least one slot disposed along the outer surface of the upper portion communicating with the gear bore and disposed above one of the fluid ports of the second ported member so that the gear bore is maintained free of particulate material by fluid induction during fluid flow through the fluid ports.

* * * * *